US007980185B1

(12) United States Patent
Teague, Jr.

(10) Patent No.: US 7,980,185 B1
(45) Date of Patent: Jul. 19, 2011

(54) LOCKING APPARATUS

(75) Inventor: Walter E. Teague, Jr., Kensington, MD (US)

(73) Assignee: Junicon Enterprises L.L.C., St. Petersburg, FL (US)

( * ) Notice: Subject to any disclaimer, the term of this patent is extended or adjusted under 35 U.S.C. 154(b) by 714 days.

(21) Appl. No.: 12/021,353

(22) Filed: Jan. 29, 2008

(51) Int. Cl.
*E05G 1/00* (2006.01)

(52) U.S. Cl. ..... 109/50; 109/51; 70/63

(58) Field of Classification Search ..... 109/50–52; 70/63

See application file for complete search history.

(56) References Cited

U.S. PATENT DOCUMENTS

| | | | | | |
|---|---|---|---|---|---|
| 1,901,904 | A | | 3/1933 | Ehrlich | |
| 2,010,877 | A | | 8/1935 | Morell | |
| 3,750,158 | A | | 7/1973 | Anastassakis | |
| 4,436,214 | A | * | 3/1984 | Henderson | 220/628 |
| 4,454,824 | A | * | 6/1984 | Wood | 109/52 |
| 4,457,240 | A | * | 7/1984 | Hungerford | 109/45 |
| 4,474,116 | A | * | 10/1984 | Castenada et al. | 109/51 |
| 4,664,041 | A | * | 5/1987 | Wood | 109/51 |
| 4,832,163 | A | * | 5/1989 | Levesque | 190/11 |
| 4,907,522 | A | * | 3/1990 | Lutzke | 114/230.28 |
| 4,998,424 | A | * | 3/1991 | Lambert, II | 70/63 |
| 5,143,108 | A | | 9/1992 | Kenney | |
| 5,199,361 | A | * | 4/1993 | Robinson | 109/51 |
| 5,235,920 | A | * | 8/1993 | Hector | 109/51 |
| 5,501,086 | A | * | 3/1996 | Sherlock | 70/58 |
| 5,740,684 | A | * | 4/1998 | Sherlock et al. | 70/58 |
| 5,881,978 | A | * | 3/1999 | Rust | 248/156 |
| 6,082,157 | A | * | 7/2000 | Boyce | 70/58 |
| 6,085,671 | A | | 7/2000 | Kerr et al. | |
| 6,971,209 | B1 | * | 12/2005 | Blevins | 52/157 |
| 7,021,866 | B2 | | 4/2006 | Keefe | |
| 7,116,224 | B2 | | 10/2006 | Mickler | |
| 7,183,903 | B2 | * | 2/2007 | Nicolson et al. | 340/426.36 |
| 7,409,915 | B2 | * | 8/2008 | Hagar | 109/50 |
| 7,559,218 | B2 | * | 7/2009 | Soudan, Jr. | 70/63 |
| 2003/0051646 | A1 | * | 3/2003 | Cinquegrano | 109/50 |
| 2005/0253702 | A1 | * | 11/2005 | Moyer | 340/539.11 |
| 2005/0268672 | A1 | * | 12/2005 | Fraser et al. | 70/57.1 |

* cited by examiner

*Primary Examiner* — Suzanne D Barrett
(74) *Attorney, Agent, or Firm* — Stevens & Showalter LLP

(57) ABSTRACT

A locking apparatus is disclosed including a lock box member and a first auger. The lock box member comprises at least one sidewall, a bottom wall including a first aperture, and a plurality of cover portions. The plurality of cover portions are selectively positionable in open and closed positions. The sidewall, the bottom wall and the plurality of cover portions define an interior portion when the cover portions are positioned in their closed positions. The lock box member further comprises structure to lock the cover portions in their closed positions, wherein the plurality of cover portions cooperate to form a second aperture therebetween when positioned in their closed positions. The first auger is attached to the lock box member.

18 Claims, 7 Drawing Sheets

LOCKING APPARATUS

FIELD OF THE INVENTION

The present invention relates generally to a locking apparatus capable of supporting an additional element.

BACKGROUND OF THE INVENTION

Recreational activities, such as trips to the beach, often involve setting up personal belongings in a common area. Often, the belongings must be tied down or otherwise secured to prevent unwanted movement or removal thereof.

Once the belongings have been set up and secured, it is often desirable to leave the common area for a period of time. In certain situations, it may also be desirable to leave personal valuable items behind, such as when one wishes to swim in the ocean, for example. However, when personal valuable items are left behind, such items are susceptible to being lost or stolen. To ensure their safekeeping, it is desirable to store the personal valuable items in a secure place where they are not accessible by third parties.

Accordingly, it would be desirable to produce a portable device that offers a lockable storage area for safekeeping of personal items, wherein the device can be securely implanted in the ground. It would also be desirable if the device could secure additional elements in place to prevent unwanted movement or removal thereof.

SUMMARY OF THE INVENTION

In accordance with a first aspect of the present invention, a locking apparatus is provided. The locking apparatus comprises a lock box member, a first auger and receiving element structure. The lock box member comprises: at least one sidewall, a bottom wall including a first aperture, and a plurality of cover portions. The plurality of cover portions are selectively positionable in open and closed positions. The at least one sidewall, the bottom wall and the plurality of cover portions define an interior portion when the cover portions are positioned in their closed positions. The plurality of cover portions cooperate to form a second aperture therebetween when positioned in their closed positions. The first auger is attached to the lock box member. The first auger comprises a first member having opposing first and second ends spaced apart from one another. The first member first end defines a threaded portion. The receiving element structure is positioned within said lock box member and extends into or near the second aperture defined by the lock box cover portions when in their closed positions, wherein the receiving element structure is adapted to receive an additional element therein.

In accordance with a second aspect of the present invention, a locking apparatus and element combination is provided. The locking apparatus comprises a lock box member and a first auger. The lock box member comprises at least one sidewall, a bottom wall, and cover structure. The cover structure is selectively positionable in one of an open and a closed position. The at least one sidewall, the bottom wall and the cover structure define an interior portion when the cover structure is positioned in its closed position. The first auger comprises a first member having opposing first and second ends spaced apart from one another. The first member first end defines a threaded portion. An attachment system releasably couples the first auger first member to the lock box member. The additional element extends through an aperture defined in the lock box member. Receiving element structure is located within the interior portion of the lock box member for receiving the additional element therein. The receiving element structure comprises a tube and securing structure to secure the additional element in position relative to the lock box member. The securing structure is accessible only when the cover structure is located in its open position.

In accordance with a third aspect of the present invention, a locking apparatus is provided. The locking apparatus comprises a lock box member, a first auger and a second auger. The lock box member comprises at least one sidewall, a bottom wall including an aperture, and cover structure. The cover structure is selectively positionable in one of an open and a closed position. The at least one sidewall, the bottom wall and the cover structure define an interior portion when the cover structure is located in its closed position. The first auger is associated with the lock box member and comprises a first member having opposing first and second ends spaced apart from one another. The first member first end defines a threaded portion capable of being threaded into ground. The second auger comprises a second member having opposing first and second ends spaced apart from one another. The second member first end defines a threaded portion and is adapted to pass through the aperture in the lock box member bottom wall so as to allow the second member first end to be threaded into ground. The second auger is not capable of being removed from ground when the cover structure is in its closed position.

BRIEF DESCRIPTION OF THE DRAWINGS

The following detailed description of the preferred embodiments of the present invention can best be understood when read in conjunction with the following drawings, where like structure is indicated with like reference numerals, and in which.

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
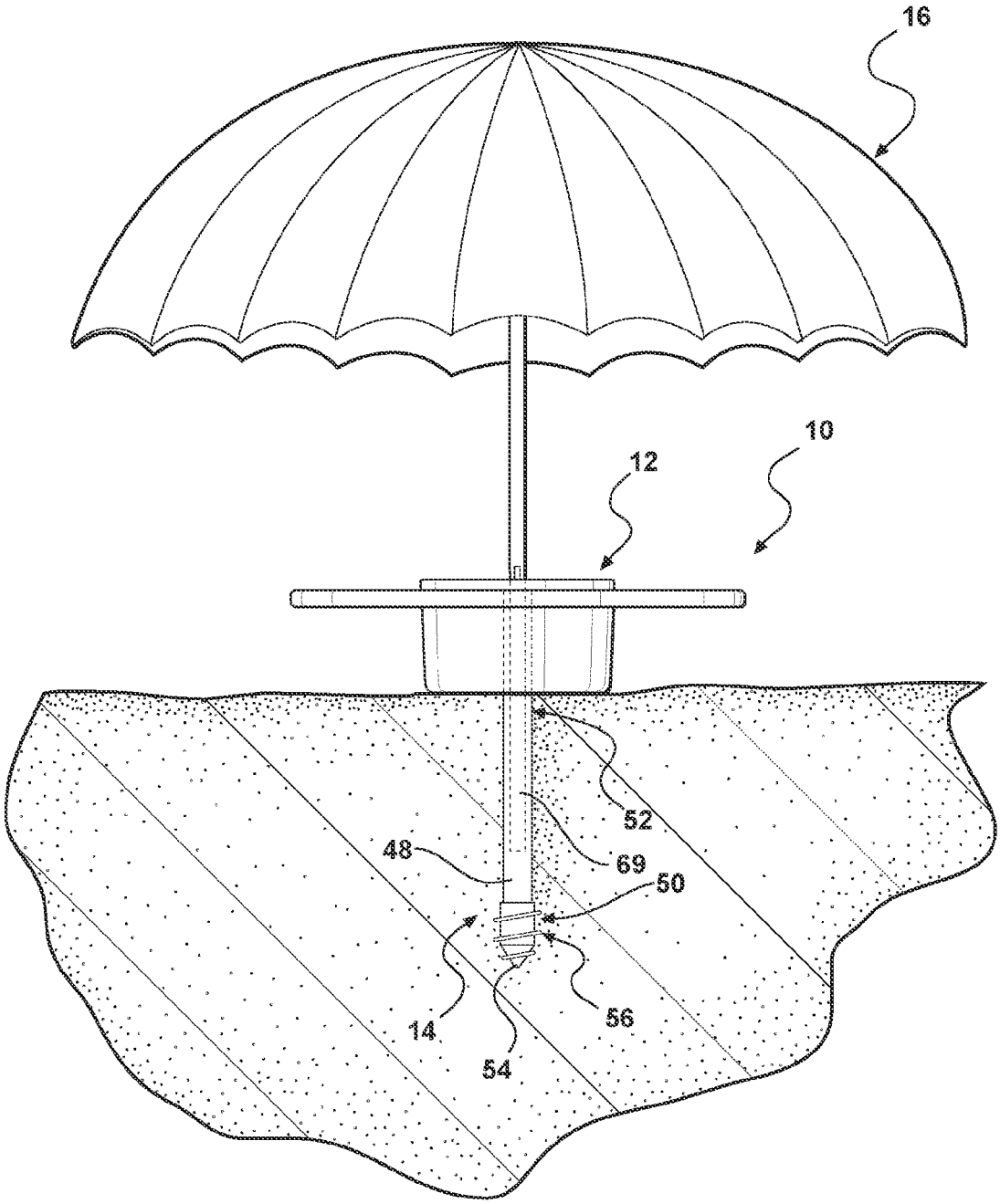
FIG. 1 is a side view, partially in cross section, of a locking system installed in the ground in accordance with an embodiment of the invention.
Figure 3:
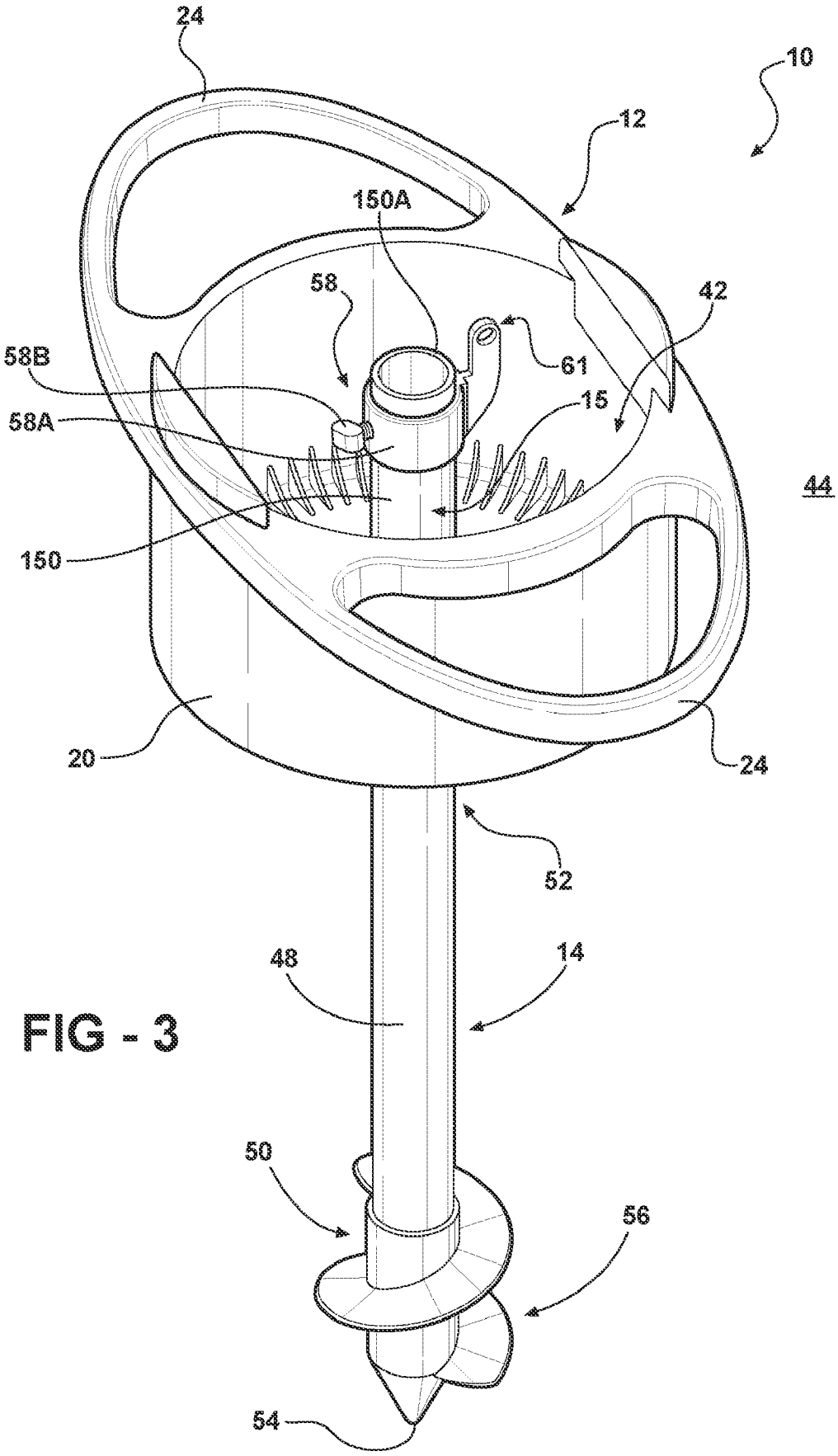
FIG. 3 is a perspective top view of the locking system illustrated in FIGS. 1-2 shown without first and second cover portions.

Referring now to FIG. 1, a locking apparatus 10 constructed in accordance with a first embodiment of the present invention is illustrated. The locking apparatus 10 comprises a lock box member 12, an associated first auger 14 and a receiving element structure 15, see also FIG. 3. The locking apparatus 10 is adapted to support an additional element 16, such as an umbrella, although other types of elements (not shown) can be supported as desired, such as a fishing rod, for example.

Figure 4:
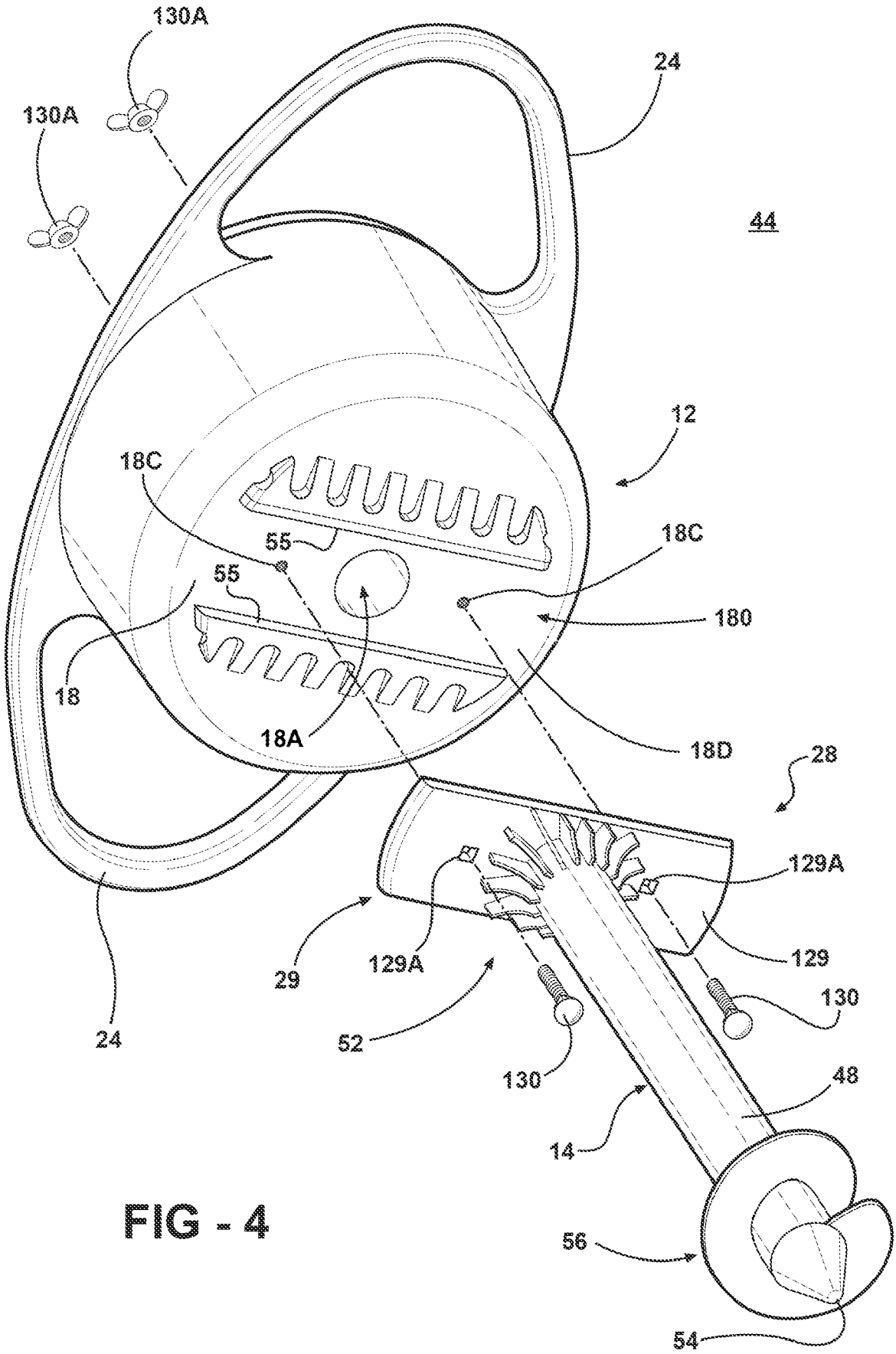
FIG. 4 is an exploded perspective bottom view of the locking system illustrated in FIGS. 1-3.

As more clearly shown in FIGS. 2-6, the lock box member 12 includes a bottom wall 18, a side wall 20, and cover structure 22. The side wall 20 is substantially cylindrical in the illustrated embodiment. However, the side wall 20 may have other shapes, such as square, oval, and the like. First and second leveraging handles 24 extend radially outwardly from opposed sides of the side wall 20. As shown in FIG. 4, the bottom wall 18 includes an opening or aperture 18A.

Figure 2:
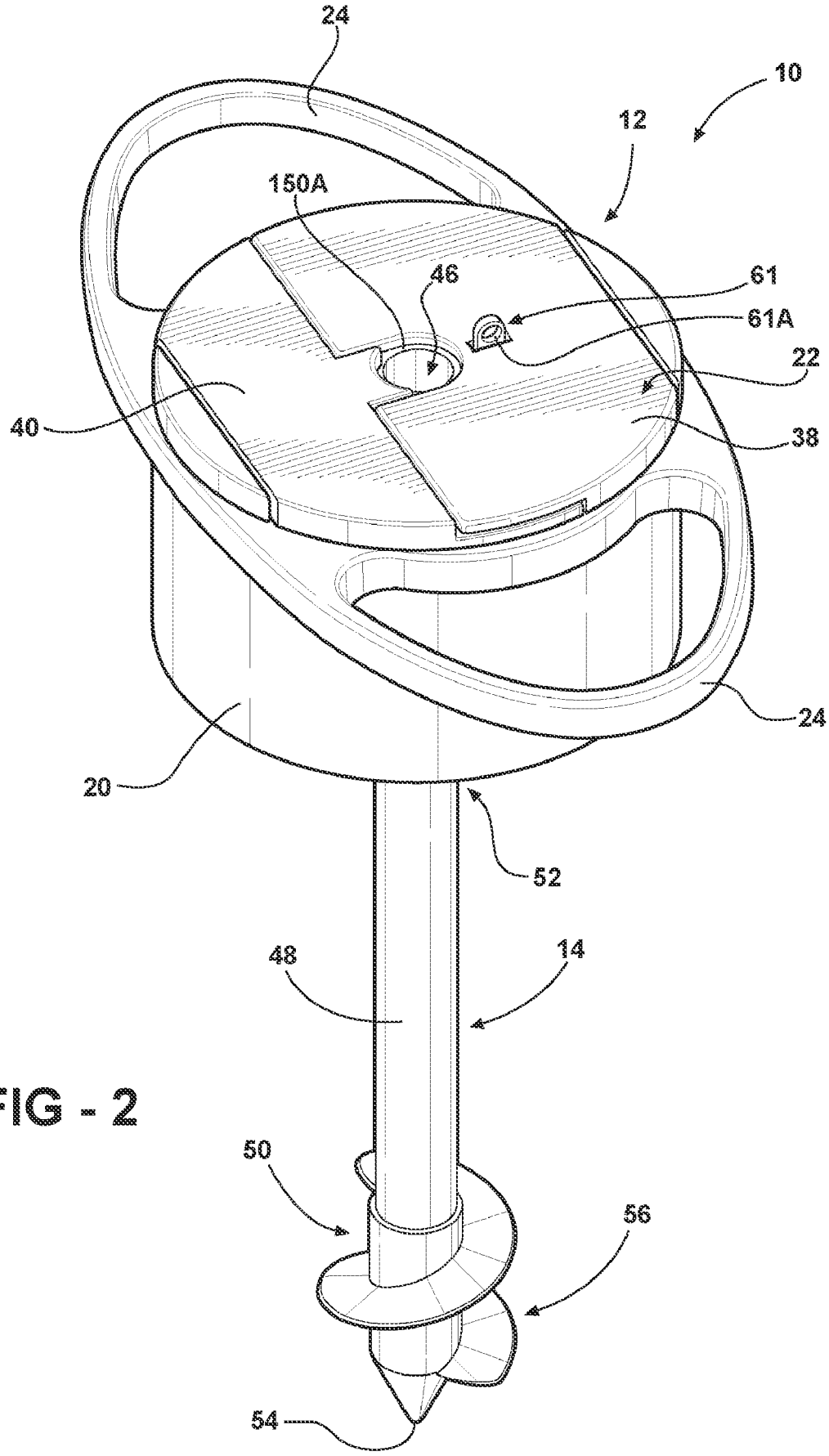
FIG. 2 is a perspective top view of the locking system illustrated in FIG. 1 shown in a closed position.
Figure 5:
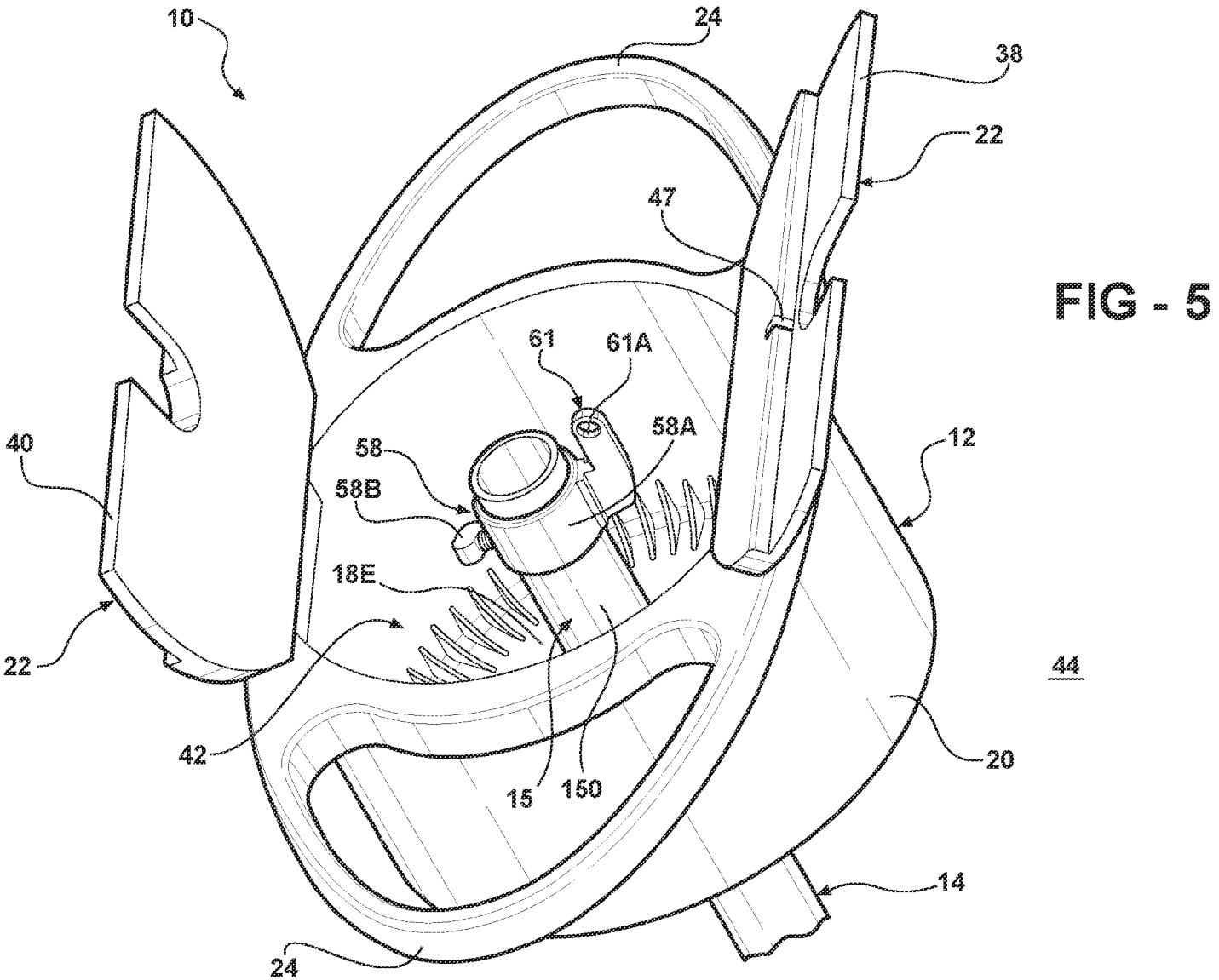
FIG. 5 is a top perspective view of the locking system illustrated in FIGS. 1-2 with the first and second cover portions open.
Figure 6:
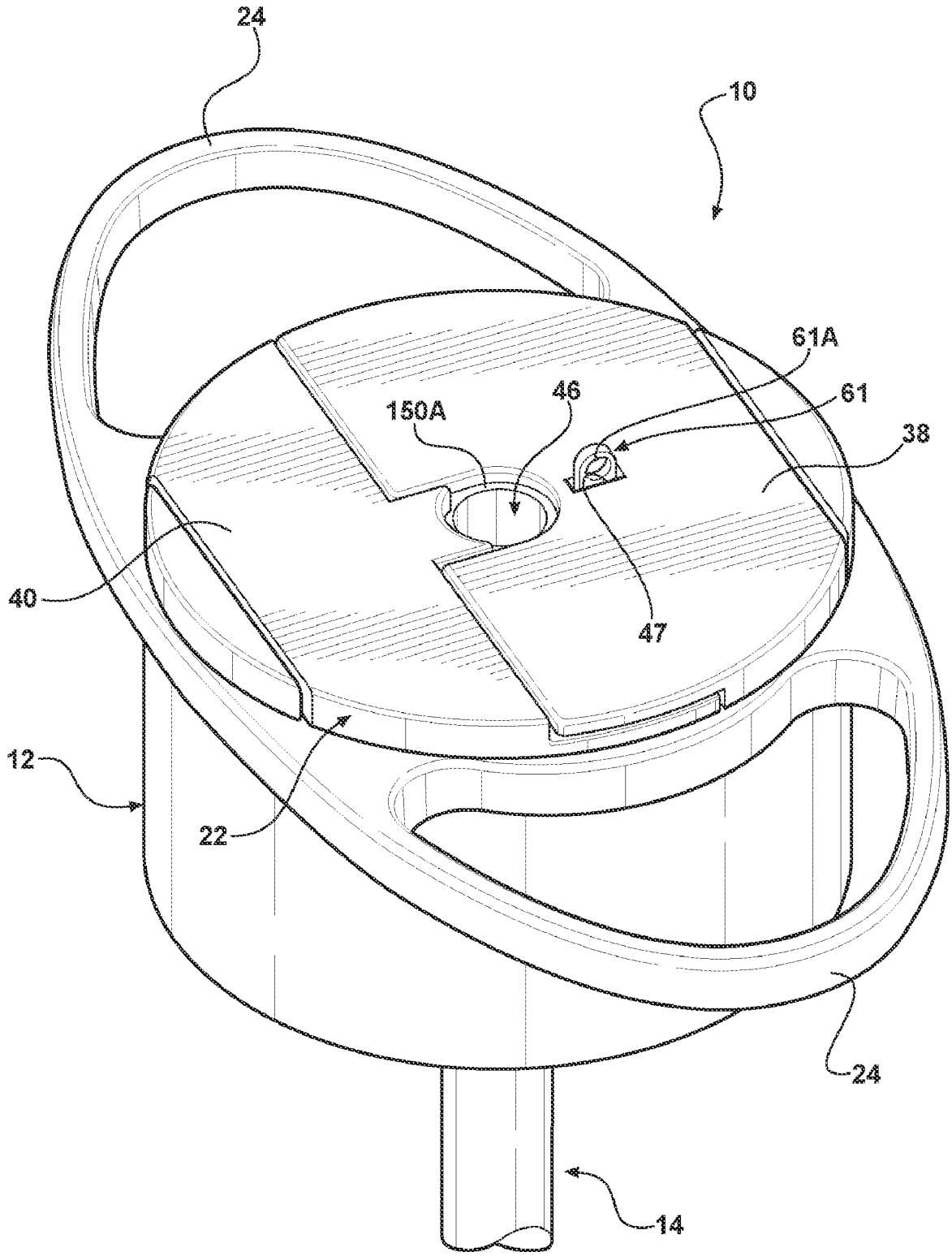
FIG. 6 is an enlarged top perspective view of a portion of the locking system illustrated in FIG. 2.

The cover structure 22 comprises a first cover portion 38 and a second cover portion 40, see FIGS. 2 and 5. It is understood that additional or fewer cover portions can be used to form the cover structure 22 as desired. Each of the first cover portion 38 and the second cover portion 40 is coupled to the side wall 20 via a corresponding hinge (not shown) or other well known coupling structure so as to allow the first and second cover portions 38, 40 to move relative to the side wall 20 between a closed position, as shown in FIG. 2, and an open position, as shown in FIG. 5. When the cover portions 38, 40 are in their closed positions, an interior portion 42 of the lock box member 12, which is defined by the bottom wall 18, the side wall 20, and the cover structure 22, is not accessible from an outside location 44 of the lock box member 12. When the cover portions 38, 40 are in their closed positions, the first cover portion 38 overlaps the second cover portion 40, see FIG. 2, so as to prevent the second cover portion 40 from being moved to its open position until the first cover portion 38 is first moved away from its closed position. Further, the cover portions 38, 40 cooperate when in their closed positions to define a second aperture 46, see FIG. 2. The second aperture 46 is substantially axially aligned with the first aperture 18A formed in the bottom wall 18. The first cover portion 38 includes a slot 47 formed therein, see FIG. 6. When the first cover portion 38 or both the first and second cover portions 38, 40 are in an open position, the interior portion 42 of the lock box member 12 is accessible from the outside location 44 of the lock box member 12.

In the illustrated embodiment, the lock box member 12 is formed from a polymeric material, although other materials may be used to form the lock box member 12 such as a wood or metal.

In the illustrated embodiment, the first auger 14 is formed from a polymeric material, although other materials may be used to form the first auger 14 as desired. The first auger 14 includes a generally cylindrical first member 48 having first and second ends 50 and 52, see FIG. 3. The first end 50 includes a pointed tip 54 and a spiraling threaded portion 56.

An attachment system 28 is provided for coupling the first auger 14 to the lock box member 12. The attachment system 28 comprises support structure 29 and first and second fasteners, bolts 130 and wing nuts 130A, in the illustrated embodiment. In the illustrated embodiment, the support structure 29 comprises a substantially rectangular plate 129 formed integrally with the second end 52 of the first auger first member 48. The plate 129 is secured to the bottom wall 18 of the lock box member 12 via the bolts 130 and the wing nuts 130A, wherein the bolts 130 extend through openings 129A in the plate 129 and openings 18C in the lock box member bottom wall 18. The wings nuts 130A are coupled to the bolts 130 after they pass through the openings 129A in the plate 129 and the openings 18C in the lock box member bottom wall 18. The wing nuts 130A are only accessible for removal via the interior portion 42 of the lock box member 12 when either the first cover portion 38 or both the first and second cover portions 38 and 40 are open. Ledges 55 extend out from an outer surface 18D of the lock box member bottom wall 18 and defines a recess 180 for receiving the plate 129. The ledges 55 assist in transferring rotational forces from the lock box member 12 to the first auger 14.

The receiving element structure 15 comprises a generally cylindrical tube 150 formed integral with the lock box member bottom wall 18. The receiving element structure tube 150 extends out from an inner surface 18E of the lock box member bottom wall 18 and is substantially axially aligned with the first aperture 18A in the bottom wall 18. A first end 150A of the tube 150 preferably extends into or near the aperture 46 defined by the first and second cover portions 38 and 40 when closed so as to seal off the interior portion 42 of the lock box member 12 when the first and second cover portions 38 and 40 are closed, see FIGS. 2 and 6.

The receiving element structure tube 150 is capable of receiving the additional element 16 therein. The additional element 16 may extend completely through the tube 150 and pass into a bore in the generally cylindrical first member 48. It is also contemplated that the tube 150 and first member 48 may comprise a single, connected element extending through the opening 18A.

The receiving element structure 15 further includes securing structure 58 for securing the additional element 16 to the tube 150. In the embodiment shown, the securing structure 58 comprises an attachment ring 58A positioned about the receiving element structure tube 150. The attachment ring 58A is fixedly coupled to the tube 150 via a bolt 58B extending through a threaded bore in the ring 58A and a threaded bore in the receiving element structure tube 150. The bolt 58B has a tip which engages the additional element 16 so as to frictionally hold the additional element 16 secured in position within the receiving element structure tube 150.

A lock receiving member 61 is integral with and extends laterally and axially out from the attachment ring 58A. The lock receiving member 61 extends through the slot 47 formed in the first cover portion 38 when the first cover portion 38 is in its closed position, see FIG. 6. An opening 61A in the lock receiving member 61 is adapted to receive a portion of a locking device (not shown) such as a padlock. When the locking device portion extends through the opening 61A in the lock receiving member 61 with the first and second cover portions 38 and 40 closed, the locking device portion prevents the first and second cover portions 38 and 40 from being opened. Optionally, a theft deterrent device, such as a motion sensing device or a global positioning device, and an alarm may be located within the interior portion 42 of the lock box member 12 or elsewhere within the apparatus 10 so as to generate an alarm signal (audible and/or visual) if the apparatus is moved from a desired location or otherwise disturbed.

The apparatus 10 may be used by inserting the tip 54 of the first auger 14 into the ground G and rotating the handles 24 of the lock box member 12 in a clockwise direction while applying a downward force to the handles 24. It is understood that if the threaded portion 56 of the first auger 14 is threaded in an opposite direction, the handles 24 are rotated in a counterclockwise direction to implant the apparatus 10 into the ground G. This motion causes the threaded portion 56 of the first auger 14 to drive into the ground G so as to move the auger 14 deeper into the ground G.

Once the apparatus 10 is in a desired position, such as where the bottom wall 18 is near or abuts the ground G, the additional element 16 can be inserted into the receiving element structure tube 150. It is understood that the apparatus 10 is capable of functioning without the additional element 16 if desired. The bolt 58B of the securing structure 58 is then rotated to secure the additional element 16 to the apparatus 10. Optionally, all or part of the first member 48 of the first auger 14 may receive an elongate member 69, such as an umbrella shaft, for example, of the additional element 16 therein.

With at least one of the cover portions 38, 40 in an open position, items (not shown) such as wallets, keys, or other personal items, can be disposed in the interior portion 42 of the lock box member 12. Thereafter, all of the cover portions 38, 40 can be positioned in closed positions with the first cover portion 38 overlapping the second cover portion 40. While the first cover portion 38 is in a closed position, the lock receiving member 61 extends through the slot 47 formed in the first cover portion 38.

A locking device (not shown), such as a combination lock or a key pad lock, is then secured to the lock receiving member 61 and locked to lock the first and second cover portions 38 and 40 in their closed positions. It is understood that other means to lock the cover portions 38 and 40 in their locked positions can be used as desired, such as wherein one of the cover portions 38, 40 includes an integral locking device (not shown), for example. Once the items are locked in the apparatus 10, the theft deterrent device (not shown), if installed, can be activated. If the apparatus 10 is thereafter moved while the theft deterrent device is activated, an alarm will be triggered.

Once the first and second cover portions 38 and 40 are in their locked positions, the interior portion 42 of the lock box member 12 cannot be accessed from the outside location 44 of the lock box member 12, thus keeping the items therein safe from being lost or stolen. Further, since the securing structure 58 used to secure the additional element 16 to the apparatus 10 is located in the interior portion 42 of the lock box member 12, the securing structure 58 cannot be accessed while the cover portions 38, 40 are in their closed positions. Accordingly, the additional element 16 cannot be removed from the apparatus 10 while the cover portions 38, 40 are in their closed positions. Additionally, since the wing nuts 130A, which, as noted above, are used in combination with the bolts 130 to secure the first auger 14 to the lock box member 12, are inserted through the interior portion 42 of the lock box member 12 so as to be coupled to the bolts 130, the wing nuts 130A cannot be accessed or removed to separate the first auger 14 from the lock box member 12 while the cover portions 38, 40 are in their closed positions.

To remove the apparatus 10 from the ground G, the handles 24 of the lock box member 12 are rotated in a counter-clockwise direction while applying an upward force to the handles 24. This motion causes the threaded portion 56 of the first auger 14 to release from the ground G.

The design of the apparatus 10 permits the opening and closing of the cover portions 38, 40 without removal of the additional element 16 from the apparatus 10. Thus, items can be quickly and easily disposed in and removed from the lock box member 12. Another advantage realized by the design of the apparatus 10 is that since the tube first end 150A is positioned within or near the second aperture 46 formed by the cover portions 38, 40, the entry of unwanted substances, such as sand or water, into the interior portion 42 of the lock box member 12 is reduced when the cover portions 38, 40 are in closed positions.

Figure 7:
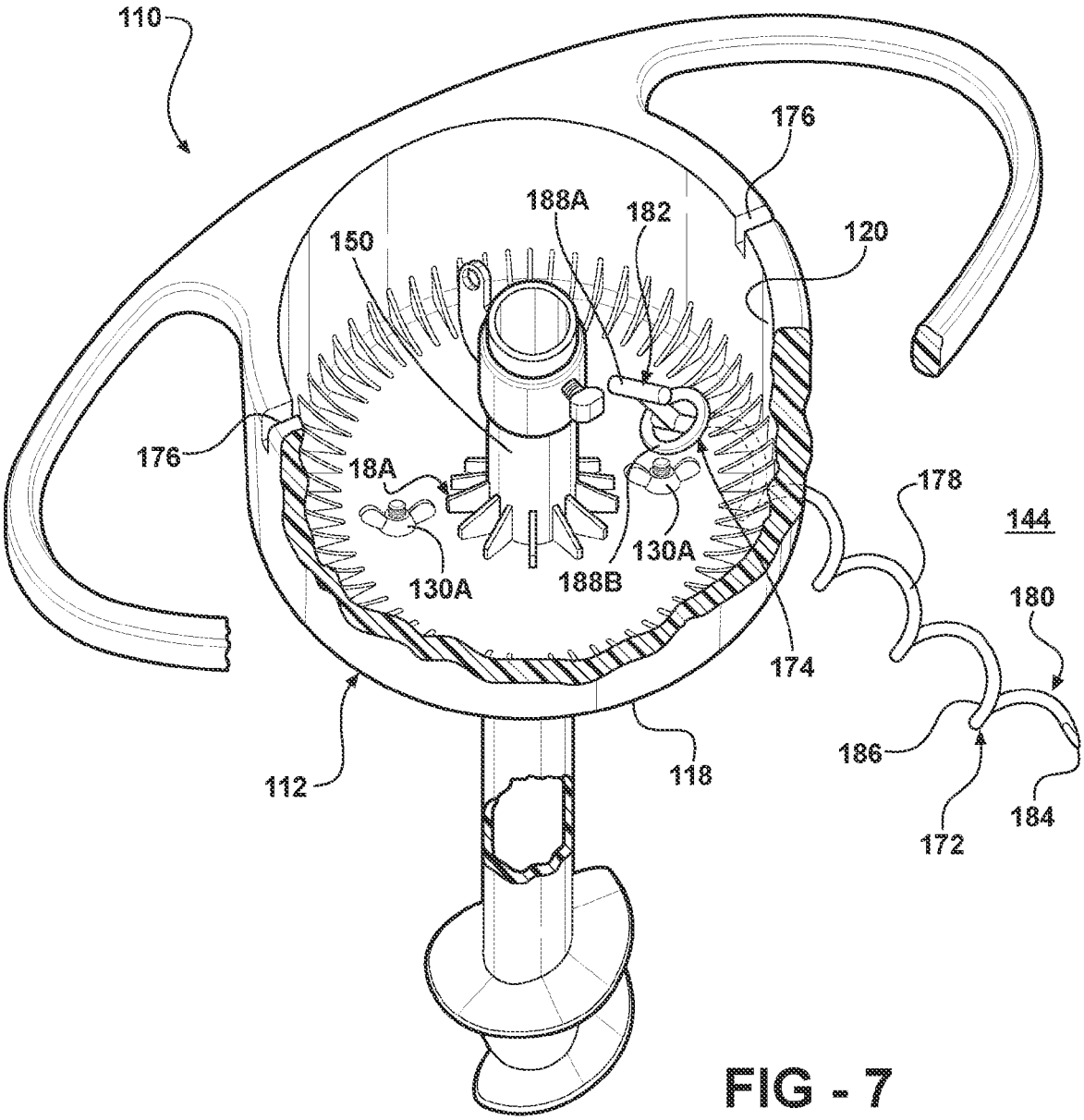
FIG. 7 is a top perspective view of a locking system including a second auger in accordance with another embodiment of the invention without first and second cover portions.

A locking apparatus 110 constructed in accordance with a second embodiment of the present invention is shown in FIG. 7, where like elements are referenced by like reference numerals. With the exception of a bottom wall 118 of a lock box member 112, a side wall 120 of the lock box member 112, and a second auger 172, the apparatus 110 is substantially similar to the apparatus 10 illustrated in FIGS. 1-6. Accordingly, only the bottom wall 118 of the lock box member 112, the side wall 120 of the lock box member 112, the second auger 172, and the associated functions thereof will be described.

The bottom wall 118 includes a second aperture 174 formed therein spaced laterally from the receiving element structure tube 150. The second aperture 174 is adapted to receive the second auger 172 therein.

The side wall 120 is cylindrical in shape and includes a pair of opposed recesses 176 which define apertures or openings when the first and second cover portions 38 and 40 (not shown in FIG. 7) are in their closed positions. The apertures are adapted to receive cables (not show) therethrough. The cables may be used to secure additional structure (not shown), such as a small boat or bicycle, for example, to the apparatus 110. The cables may include enlarged end portions that are sized to not fit through the apertures to militate against a removal of the cables from the apparatus 110.

The second auger 172 includes a second member 178 having a first end 180 and a spaced apart second end 182. The first end 180 includes a pointed tip 184 and a threaded portion 186. In the embodiment shown, the threaded portion 186 extends along substantially the entire length of the second member 178. The first end 180 is adapted to be inserted through the second aperture 174 formed in the bottom wall 118 of the lock box member 112. The second end 182 includes a handle portion 188A and a stop 188B that is sized to not fit through the second aperture 174 formed in the bottom wall 118.

Once the apparatus 110 is disposed in the ground (not shown) and while at least one of a first cover portion 38 and a second cover portion 40 are in an open position, the pointed tip 184 of the second auger 172 is inserted into an interior portion 142 of the lock box member 112 and through the second aperture 174 formed in the bottom wall 118. The handle portion 188A of the second auger 172 is then rotated in a clockwise direction while applying a downward force to the handle portion 188A. This motion causes the threaded portion 186 of the second auger 172 to drive into the ground. It is understood that if the threaded portion 186 of the second auger 172 is threaded in the opposite direction than that shown, the handle portion 188A is rotated in a counter-clockwise direction to implant the second auger 172 into the ground.

Once implanted into the ground, the second auger 172 militates against a removal of the apparatus 110 from the ground by providing additional resistance against an upward movement of the apparatus 110, such as an unauthorized removal of the apparatus 110. Additional augers (not shown) may be associated with the apparatus 110 as desired. The additional augers would provide further resistance against unauthorized removal of the apparatus 110. When the second auger 172 is implanted in the ground and the handle portion 188A is disposed entirely in the interior portion 142 of the lock box member 112, unless at least one of the cover portions is in an open position, access to the second auger 172 is not available from an outside position 144 of the lock box member 112. Accordingly, removal of the second auger 172 from the ground is militated against, thus maximizing a security of the apparatus 110.

To remove the apparatus 110 from the ground, while at least one of the cover portions is in an open position, the handle portion 188A of the second auger 172 is rotated in a counter-clockwise direction while applying an upward force to the handle portion 188A. This motion releases the second auger 172 from the ground. Remaining removal of the apparatus from the ground is the same as that described above with regards to FIGS. 1-6.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A locking apparatus comprising:

a lock box member comprising at least one sidewall, a bottom wall including a first aperture, and a plurality of cover portions, said plurality of cover portions being selectively positionable in open and closed positions, said at least one sidewall, said bottom wall and said plurality of cover portions defining an interior portion when said cover portions are positioned in their closed positions, wherein said plurality of cover portions cooperate to form a second aperture therebetween when positioned in their closed positions;

a first auger attached to said lock box member, said first auger comprising a first member having opposing first and second ends spaced apart from one another and said first member first end defining a threaded portion; and receiving element structure positioned within said lock box member and extending into or near said second aperture defined by said lock box cover portions when in their closed positions, wherein said receiving element structure is adapted to receive an additional element therein.

2. The locking apparatus of claim 1, wherein said lock box member is formed from a polymeric material.

3. The locking apparatus of claim 1, further comprising an attachment system comprising support structure coupled to said first member of said first auger and at least one fastener to removably attach said support structure to said lock box member.

4. The locking apparatus of claim 3, wherein said at least one fastener is only accessible from an outside location of said lock box member when at least one of said cover portions is in an open position.

5. The locking apparatus of claim 1, wherein said receiving element structure comprises a tube and securing structure to secure the additional element to said tube.

6. The locking apparatus of claim 5, wherein said securing structure to secure the additional element to said tube is only accessible from an outside location of said lock box member when at least one of said cover portions is in an open position such that the additional element cannot be removed from said lock box member while both of said cover portions are positioned in their closed positions.

7. The locking apparatus of claim 1, wherein the additional element is one of an umbrella and a fishing pole.

8. The locking apparatus of claim 1, further comprising a lock receiving member to secure said cover portions in their closed positions.

9. The locking apparatus of claim 1, wherein said receiving element structure is substantially in a common plane with at least one of said cover portions when said cover portions are in their closed positions.

10. The locking apparatus of claim 1, further comprising a second auger comprising a second member having opposing first and second ends spaced apart from one another, said second member first end defining a threaded portion.

11. The locking apparatus of claim 1, further comprising at least one of a motion sensing device and a global positioning system.

12. A locking apparatus with supported element comprising:

a lock box member comprising at least one sidewall, a bottom wall, and cover structure, said cover structure being selectively positionable in one of an open and a closed position, said at least one sidewall, said bottom wall and said cover structure defining an interior portion when said cover structure is positioned in its closed position;

a first auger comprising a first member having opposing first and second ends spaced apart from one another and said first member first end defining a threaded portion;

an attachment system to releasably couple said first auger first member to said lock box member;

an additional element extending through an aperture defined in said lock box member; and receiving element structure located within said interior portion of said lock box member for receiving said additional element therein, said receiving element structure comprising a tube and securing structure to secure said additional element in position relative to said lock box member, said securing structure being accessible only when said cover structure is located in its open position and said additional element cannot be removed from said lock box member while said cover structure is positioned in its closed position; and wherein said cover structure comprises first and second cover portions which define said aperture when said first and second cover portions are located in a closed position.

13. The locking apparatus of claim 12, wherein said securing structure comprises a fastener.

14. The locking apparatus of claim 12, wherein said lock box member further comprises one or more apertures through which a cable is capable of extending, said cable being secured to said lock box member when said cover structure is located in its closed position.

15. The locking apparatus of claim 12, further comprising a second auger comprising a second member having opposing first and second ends spaced apart from one another, said second member first end defining a threaded portion adapted to pass through an aperture in said lock box member bottom wall so as to be threaded into ground.

16. A locking apparatus comprising:

a lock box member comprising at least one sidewall, a bottom wall including an aperture, and cover structure, said cover structure being selectively positionable in one of an open and a closed position, said at least one sidewall, said bottom wall and said cover structure defining an interior portion when said cover structure is located in its closed position;

a first auger coupled to said lock box member such that rotational forces are transferable from said lock box member to said first auger, said first auger comprising a first member having opposing first and second ends spaced apart from one another and said first member first end defining a threaded portion capable of being threaded into ground; and a second auger comprising a second member having opposing first and second ends spaced apart from one another, said second member first end defining a threaded portion and being adapted to pass through said aperture in said lock box member bottom wall so as to allow said second member first end to be threaded into ground, said second auger not being removable from ground when said cover structure is in its closed position.

17. The locking apparatus of claim 16, wherein said first auger first member is generally centrally positioned relative to said lock box member bottom wall and said second auger second member is laterally spaced away from said first auger first member.

18. The locking apparatus of claim 16, wherein said first auger is not removable from ground while said second auger is in ground.

* * * * *